US010858142B2

(12) United States Patent
Boukredine

(10) Patent No.: US 10,858,142 B2
(45) Date of Patent: Dec. 8, 2020

(54) CARTON AND CARTON BLANK

(71) Applicant: WestRock Packaging Systems, LLC, Norcross, GA (US)

(72) Inventor: Eric Boukredine, Ambrault (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 118 days.

(21) Appl. No.: 15/570,820

(22) PCT Filed: May 12, 2016

(86) PCT No.: PCT/US2016/031970
§ 371 (c)(1),
(2) Date: Oct. 31, 2017

(87) PCT Pub. No.: WO2016/183265
PCT Pub. Date: Nov. 17, 2016

(65) Prior Publication Data

US 2018/0148215 A1 May 31, 2018

(30) Foreign Application Priority Data

May 12, 2015 (GB) ..... 1508106.0

(51) Int. Cl.
*B65D 5/36* (2006.01)
*B65D 71/36* (2006.01)

(52) U.S. Cl.
CPC ..... *B65D 5/3628* (2013.01); *B65D 71/36* (2013.01); *B65D 2571/0045* (2013.01); *B65D 2571/0066* (2013.01); *B65D 2571/00185* (2013.01); *B65D 2571/00728* (2013.01); *B65D 2571/00932* (2013.01); *B65D 2571/00962* (2013.01);
(Continued)

(58) Field of Classification Search
CPC ..... B65D 5/3628; B65D 71/36; B65D 2571/00185; B65D 2571/0045; B65D 2571/0066; B65D 2571/00728; B65D 2571/00932; B65D 2571/00962; B65D 2571/00969; B65D 2571/00975
USPC ..... 206/147
See application file for complete search history.

(56) References Cited

U.S. PATENT DOCUMENTS 3,204,814 A 9/1965 Mahon
3,688,972 A 9/1972 Mahon
4,029,207 A 6/1977 Gordon
(Continued)

FOREIGN PATENT DOCUMENTS

EP 0446042 A1 9/1991
WO WO2007/035754 A2 3/2007

*Primary Examiner* — Andrew D Perreault
(74) *Attorney, Agent, or Firm* — Brian J. Goldberg

(57) ABSTRACT

A carton of the gable top style for packaging one or more articles. The carton includes a plurality of panels for forming walls of the carton including: a first side panel; a first end panel having an upper portion and a lower portion; a web panel formed from part of the upper portion and hinged to the first side panel. The carton is convertible from a flat collapsed form into an erected form. In the flat collapsed form, the first side panel is disposed in an overlying or face to face relationship with the first end panel. In the erected form, the first side panel and the first end panel form walls of a tubular structure and define at least in part an interior of the carton for receiving one or more articles.

4 Claims, 14 Drawing Sheets

(52) U.S. Cl.
CPC ..... *B65D 2571/00969* (2013.01); *B65D 2571/00975* (2013.01)

(56) References Cited

U.S. PATENT DOCUMENTS

| | | | | |
|---|---|---|---|---|
| 4,202,446 | A * | 5/1980 | Sutherland | B65D 71/36 206/1.5 |
| 4,375,258 | A | 3/1983 | Crayne et al. | |
| 5,542,536 | A | 5/1996 | Sutherland | |
| 2013/0105563 | A1* | 5/2013 | Lee | B65D 5/24 229/186 |

* cited by examiner

CARTON AND CARTON BLANK

CROSS-REFERENCE TO RELATED APPLICATIONS

This application is a National Phase application of PCT Application PCT/US2016/031970, filed May 12, 2016, which claims the benefit of GB Patent Application No. 1508106.0, filed May 12, 2015, both of which are incorporated herein by reference in their entirety.

TECHNICAL FIELD

The present invention relates to a carton and blank for forming the same more specifically, but not exclusively, to a carton comprising tapered upper end wall portions which are automatically erectable.

BACKGROUND

In the field of packaging it is often required to provide consumers with a package comprising multiple primary product containers. Such multi-packs are desirable for shipping and distribution purposes and for the display of promotional information. For cost and environmental considerations, such cartons or carriers need to be formed from as little material as possible and cause as little wastage as possible in the materials from which they are formed. Another consideration is the strength of the packaging and its suitability for holding and transporting large weights of articles.

It is desirable to provide a carton which can be distributed in a flat collapsed form to a processing plant, such as but not limited to a bottling plant, and which can be erected into a package without requiring any adhesive securing processes at the processing plant.

The present invention seeks to overcome or at least mitigate the problems of the prior art.

SUMMARY

According to a first aspect of the present invention there is provided a carton of the gable top style for packaging one or more articles. The carton comprises a plurality of panels for forming walls of the carton including: a first side panel; a first end panel having an upper portion which may optionally be hingedly connected to a lower portion; a web panel struck from the upper portion and hinged to the first side panel. The carton can take a flat collapsed form and an erected form wherein in the flat collapsed form, the first side panel is disposed in an overlying or face to face relationship with the first end panel. In the erected form, the first side panel and the first end panel form walls of a tubular structure and define at least in part an interior of the carton for receiving one or more articles. The web panel is retained in face to face relationship with the first side panel when the carton is erected.

Optionally, the web panel is adhesively secured to the first side panel.

Optionally, the carton comprises a top panel, an anchor panel hingedly connected to the top panel and a gusset panel, and wherein the web panel is coupled to the anchor panel by the gusset panel.

Optionally, the anchor panel is secured to the top panel in face contacting relationship.

According to a second aspect of the present invention there is provided a carton of the gable top style for packaging one or more articles. The carton comprises a plurality of panels for forming walls of the carton including: a top panel; a first side panel; a first end panel having an upper portion which may optionally be hingedly connected to a lower portion; a web panel formed from part of the upper portion and hinged to the first side panel. The carton can take a flat collapsed form and an erected form. In the flat collapsed form, the first side panel is disposed in an overlying relationship with the first end panel. In the erected form the first side panel and the first end panel form walls of a tubular structure and define at least in part an interior of the carton for receiving one or more articles. The web panel is retained in a folded condition when the carton is erected whereby automatically folding the upper portion of the first end panel with respect to the lower portion such that the upper portion of the first end panel tapers inwardly towards the top panel.

Optionally, the web panel is adhesively secured to the first side panel.

Optionally, the carton comprises a top panel, an anchor panel hingedly connected to the top panel and a gusset panel, and wherein the web panel is coupled to the anchor panel by the gusset panel.

Optionally, the anchor panel is secured to the top panel in face contacting relationship.

According to a third aspect of the present invention there is provided a carton of the gable top style for packaging one or more articles. The carton comprises a plurality of panels for forming walls of the carton including: a first side panel; a first end panel having an upper portion which may optionally be hingedly connected to a lower portion; a web panel formed from the upper portion and secured to the first side panel. The carton is convertible from a flat collapsed form into an erected form. In the flat collapsed form, the first side panel is disposed in an overlying relationship with the first end panel. In the erected form, the first side panel and the first end panel form walls of a tubular structure and define at least in part an interior of the carton for receiving one or more articles. The upper portion of the first end panel is automatically folded with respect to the lower portion such that the upper portion of the first end panel tapers inwardly towards the top panel when the carton is erected from the flat collapsed form.

According to a fourth aspect of the present invention there is provided a carton of the gable top style for packaging one or more articles. The carton comprises a plurality of panels for forming walls of the carton including: a top panel; a first side panel; a first end panel having an upper portion which may optionally be hingedly connected to a lower portion; an anchor panel hinged to the top panel and disposed in face to face relationship with the top panel; a gusset panel coupling the anchor panel to the upper portion of the first end panel. The carton is transformable from a flat collapsed form into an erected form. In the flat collapsed form, the first side panel is disposed in an overlying or face to face relationship with the first end panel while in the erected form, the first side panel and the first end panel form walls of a tubular structure and define at least in part an interior of the carton for receiving one or more articles. The upper portion of the first end panel is automatically folded with respect to the lower portion such that the upper portion of the first end panel tapers inwardly towards the top panel when the carton is erected.

Optionally, the carton comprises a web panel is formed, and optionally struck, from the upper portion and hinged to the first side panel, and wherein the web panel is retained in a face to face relation with the first side panel when the carton is erected.

According to a fifth aspect of the present invention there is provided a carton of the gable top style for packaging one or more articles. The carton comprises a plurality of panels for forming walls of the carton including: a top panel; a first side panel; a first end panel having an upper portion which may optionally be hingedly connected to a lower portion; a web panel is formed from the upper portion and hinged to the first side panel, an anchor panel hinged to the top panel and disposed in face to face relationship with the top panel; a gusset panel coupling the anchor panel to the upper portion of the first end panel. The carton can take a flat collapsed form and an erected form. In the flat collapsed form, the first side panel is disposed in an overlying relationship with the first end panel while in the erected form, the first side panel and the first end panel form walls of a tubular structure and define at least in part an interior of the carton for receiving one or more articles. The web panel is retained in a folded condition when the carton is erected whereby automatically folding the upper portion of the first end panel with respect to the lower portion such that the upper portion of the first end panel tapers inwardly towards the top panel.

According to a sixth aspect of the present invention there is provided a blank for forming a carton of the gable top style. The blank comprises a plurality of panels for forming walls of the carton including:

a first side panel;

a first end panel having an upper portion hingedly connected to a lower portion;

a web panel formed from the upper portion and hinged to the first side panel, wherein the blank may take a flat collapsed form in which the first side panel is disposed in an overlying or face to face relationship with the first end panel, the blank is manipuable from the flat collapsed form into an erected form in which the first side panel and the first end panel form walls of a tubular structure and define at least in part an interior for receiving one or more articles, wherein the web panel is retained in face to face relationship with the first side panel when the blank is manipulated into the erected form.

According to a seventh aspect of the present invention, there is provided a blank for forming a carton of the gable top style. The blank comprises a plurality of panels for forming walls of the carton including:

a top panel;

a first side panel;

a first end panel having an upper portion hingedly connected to a lower portion;

a web panel formed from the upper portion and hinged to the first side panel, wherein the blank may be folded into a flat collapsed form in which the first side panel is disposed in an overlying relationship with the first end panel, the blank is manipuable from the flat collapsed form into an erected form in which the first side panel and the first end panel form walls of a tubular structure and define at least in part an interior for receiving one or more articles, wherein the web panel is retained in a folded condition, when the blank is manipulated into the erected form, whereby automatically folding the upper portion of the first end panel with respect to the lower portion such that the upper portion of the first end panel tapers inwardly towards the top panel.

According to an eighth aspect of the present invention there is provided a blank for forming a carton of the gable top style. The blank comprises a plurality of panels for forming walls of the carton including:

a first side panel;

a first end panel having an upper portion hingedly connected to a lower portion;

a web panel formed from the upper portion and secured to the first side panel, wherein the blank may be folded into a flat collapsed form in which the first side panel is disposed in an overlying relationship with the first end panel, the blank is manipuable from the flat collapsed form into an erected form in which the first side panel and the first end panel form walls of a tubular structure and define at least in part an interior for receiving one or more articles, wherein the upper portion of the first end panel is automatically folded with respect to the lower portion such that the upper portion of the first end panel tapers inwardly towards the top panel when the blank is manipulated into the erected form from the flat collapsed form.

According to a ninth aspect of the present invention there is provided a blank for forming a carton of the gable top style. The blank comprises a plurality of panels for forming walls of the carton including:

a top panel;

a first side panel;

a first end panel having an upper portion hingedly connected to a lower portion;

a web panel formed from part of the upper portion and hinged to the first side panel, an anchor panel hinged to the top panel and disposed in face to face relationship with the top panel;

a gusset panel coupling the anchor panel to the upper portion of the first end panel;

wherein the blank may be folded into a flat collapsed form in which the first side panel is disposed in an overlying relationship with the first end panel, the blank is manipuable from the flat collapsed form into an erected form in which the first side panel and the first end panel form walls of a tubular structure and define at least in part an interior for receiving one or more articles, wherein the web panel is retained in a folded condition when the blank is manipulated into the erected form from the flat collapsed form, and the upper portion of the first end panel is automatically folded with respect to the lower portion such that the upper portion of the first end panel tapers inwardly towards the top panel.

According to a tenth aspect of the present invention there is provided a blank for forming a carton of the gable top style. The blank comprises a plurality of panels for forming walls of the carton including: a top panel; a first side panel; a first end panel having an upper portion hingedly connected to a lower portion; an anchor panel hinged to the top panel and disposed in face to face relationship with the top panel; a gusset panel coupling the anchor panel to the upper portion of the first end panel. The blank may be folded into a flat collapsed form in which the first side panel is disposed in an overlying or face to face relationship with the first end panel. The blank is manipuable from the flat collapsed form into an erected tubular form in which the first side panel and the first end panel form walls of a tubular structure and define at least in part an interior of the carton for receiving one or more articles. The upper portion of the first end panel is automatically folded with respect to the lower portion such that the upper portion of the first end panel tapers inwardly towards the top panel when the blank is manipulated into the erected form from the flat collapsed form.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EXEMPLARY EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
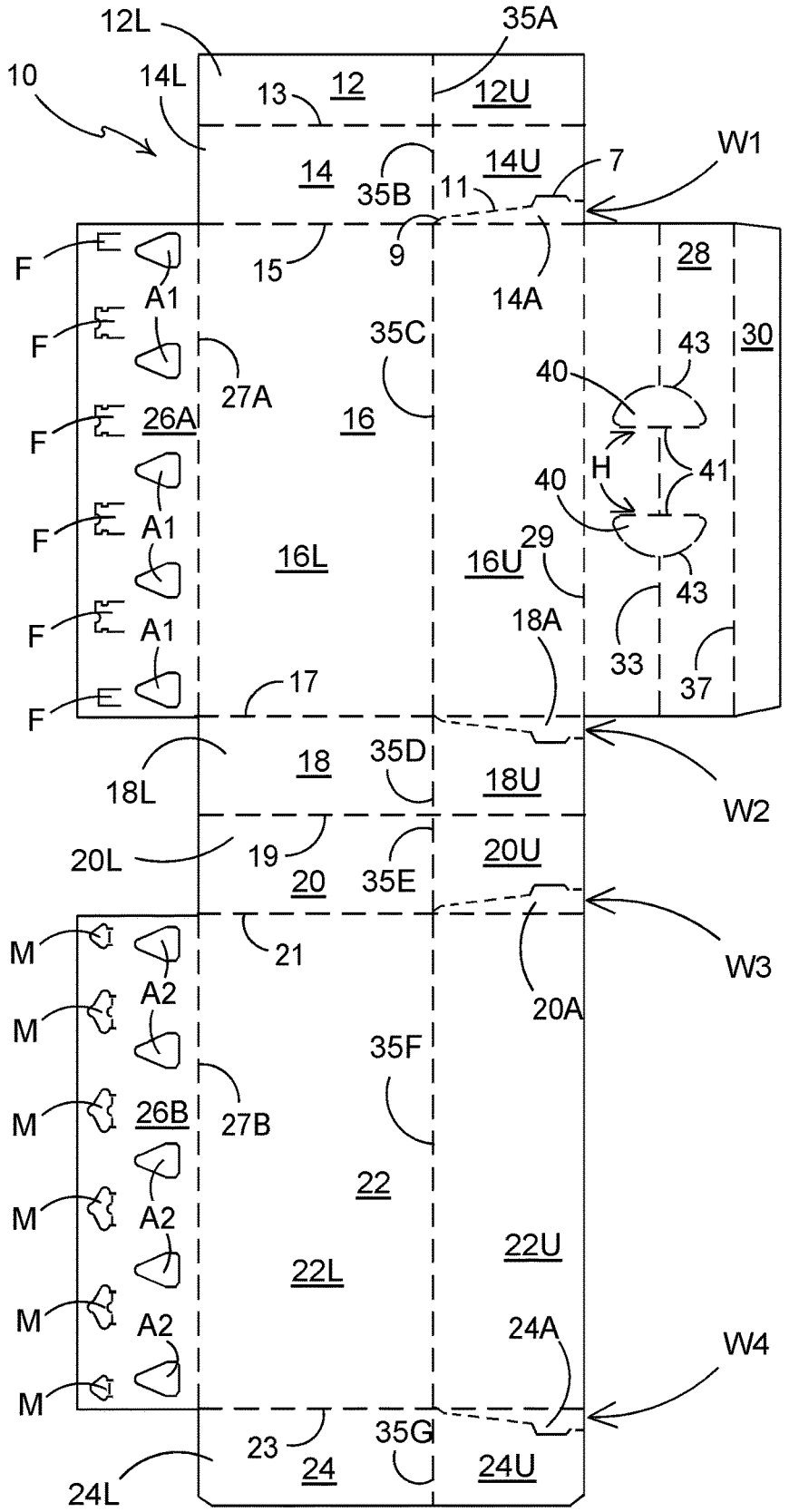
FIG. 1 is a plan view from above of a blank for forming a carton according to an embodiment of the invention.

Referring to FIG. 1 there is shown a blank 10 for forming a carton 90 capable of accepting an input of primary products such as, but not limited to, bottles or cans, hereinafter referred to as articles.

The blank 10 comprises a plurality of main panels 12, 14, 16, 18, 20, 22, 24 hinged one to the next in a linear series. A first securing panel 12 is hinged to a first end wall panel 14 by a hinged connection such as a fold line 13. The first end wall panel 14 is hinged to a first side wall panel 16 by a hinged connection such as a fold line 15. The first side wall panel 16 is hinged to a second end wall panel 18 by a hinged connection such as a fold line 17. The second end wall panel 18 is hinged to a third end panel 20 by a hinged connection such as a fold line 19. The fourth end wall panel 20 is hinged to a second side panel 22 by a hinged connection such as a fold line 21. The second side panel 22 is hinged to a fourth end panel 24 by a hinged connection such as a fold line 23.

The plurality of main panels 12, 14, 16, 18, 20, 22, 24 of the blank 10 form walls of a tubular structure in a set-up condition. The tubular structure is at least partially closed by end closure structures.

Each of the ends of the tubular structure is at least partially closed by end closure panels which in the illustrated embodiment form a top wall and a bottom wall of the tubular structure. In the illustrated embodiment, the ends of the tubular structure are fully closed by end closure panels 26A, 26B, 28.

End closure panels 26A, 26B are configured to close a first, lower, end of the tubular structure and form a composite base panel 26A/26B of a carton 90. End closure panel 28 is configured to close a second, upper, end of the tubular structure and form a top panel 28 of a carton 90.

A first end closure panel 26A forms a first base panel 26A and is hingedly connected to a first end of the first side panel 16 by a fold line 27A. A second end closure panel 26B forms a second base panel 26B and is hingedly connected to a first end of the second side panel 22 by a fold line 27B.

A third end closure panel 28 is hingedly connected to a second end of the first side panel 16 by a fold line 29. End closure panel 28 is hingedly connected to a second securing panel 30 by a fold line 37.

The blank 10 comprises a complementary locking system for securing the first base panel 26A to the second base panel 26B. The first base panel 26A comprises at least one female component F in the form of an aperture defined by a tab. The tab is struck from the first base panel 26A and is hingedly connected thereto. In the illustrated embodiment the first base panel 26A comprises a plurality of female components F for example, but not limited to, six female components F.

The second base panel 26B comprises at least one male component M in the form of a punch tab. The punch tab is substantially arrowhead shaped and comprises shoulders or barbs for interlocking with the aperture of the female component F.

The first base panel 26A comprises at least one first aperture A1, for facilitating construction of the composite base panel 26A/26B. The second base panel 26B comprises at least one second aperture A2, for facilitating construction of the composite base panel 26A/26B. The first and second apertures A1, A2 are each substantially triangular in shape and may facilitate placing the first and second base panels in at least partial overlapping relationship with one another and may also facilitate alignment of the male components M in vertical registry or alignment with the female components F.

The top panel 28 comprises a handle structure H. The handle structure H comprises a pair of tabs 40 struck from the top panel 28 and hinged thereto by a fold line 41. Each tab 40 is defined in part by a severance line 43 which is substantially U-shaped or semicircular in shape. The pair of tabs 40 are hinged in opposition to each other.

The top panel 28 comprise a fold line 33 extending longitudinally thereacross. The fold line 33 substantially bisects the top panel 28.

The first securing panel 12 comprises a first fold line 35A, first fold line 35A divides the first securing panel 12 into an upper portion 12U and a lower portion 12L. The first end panel 14 comprises a second fold line 35B, second fold line 35B divides the first end panel 14 into an upper portion 14U and a lower portion 14L. The first side panel 16 comprises a third fold line 35C, third fold line 35C divides the first side panel 16 into an upper portion 16U and a lower portion 16L. The second end panel 18 comprises a fourth fold line 35D, fourth fold line 35D divides the second end panel 18 into an upper portion 18U and a lower portion 18L. The third end panel 20 comprises a fifth fold line 35E, fifth fold line 35E divides the third end panel 20 into an upper portion 20U and a lower portion 20L. The second side panel 22 comprises a sixth fold line 35F, sixth fold line 35F divides the second side panel 22 into an upper portion 22U and a lower portion 22L. The fourth end panel 24 comprises a seventh fold line 35G, seventh fold line 35G divides the fourth end panel 24 into an upper portion 24U and a lower portion 24L.

The first, second, third, fourth, fifth, sixth and seventh fold lines 35A, 35B, 35C, 35D, 35E, 35F, 35G are contiguously arranged and form a continuous, collinear, fold line across the blank 10.

The first, second, third, fourth, fifth, sixth and seventh fold lines 35A, 35B, 35C, 35D, 35E, 35F, 35G facilitate the formation of the blank 10 into a carton 90 having a gable top. The top panel 28 is smaller in a transverse direction (the transverse direction extends between the first and second side panels 16, 22) than the composite base panel 26A, 26B.

The upper portion 16U of the first side panel 16 is convergently arranged in a setup carton 90 with respect to the upper portion 22U of the second side panel 22. The upper portion 16U converges with respect to the upper portion 22U towards the top panel 28.

The upper portion 12U of the first securing panel 12, the upper portion 14U of the first end panel 14 and upper portion 12U of the fourth end panel 24 are convergently arranged, in a setup carton 90, with respect to the upper portion 18U of the second end panel 18 and the upper portion 20U of the third end panel 20. The upper portions 12U, 14U, 24U converge with respect to the upper portions 18U, 29U towards the top panel 28.

The first end panel 14 comprises a first web structure W1 formed from part of the upper portion 14U. The second end panel 18 comprises a second web structure W2 formed from part of the upper portion 18U. The third end panel 20 comprises a third web structure W3 formed from part of the upper portion 20U. The fourth end panel 24 comprises a fourth web structure W4 formed from part of the upper portion 24U.

The first, second, third and fourth web structures W1, W2, W3, W4 are substantially similar in construction and will be described in further detail by reference to the first web structure W1 only. The first web structure W1 comprises a first web panel 14A formed from part of the upper portion 14U of the first end panel 14. The first web panel 14A is hinged to the first end panel by a fold line 11. The first web panel 14A is hinged to the first side panel by a portion of the fold line 15. The fold line 11 is divergently arranged with respect to the fold line 15. The fold line 11 and the fold line 15 diverge with respect to each towards an upper free edge of the first end panel 14. A cut line 9 is defined in the upper portion 14U of the first end panel 14. The cut line 9 extends from a vertex between the fold line 35B and the fold line 15 to a first end of the fold line 11. Optionally, the fold line 11 is interrupted by a cut line 7. Cutline 7 may be substantially U Shaped. Cutline 7 provide that the surface area of the first web panel 14A is increased without effecting the angle of inclination of the upper portion of the first side panel 16U with respect to the lower portion 16L.

The carton 90 can be formed by a series of sequential folding operations in a straight line machine so that the carton 90 may not be required to be rotated or inverted to complete its construction. The folding process is not limited to that described below and may be altered according to particular manufacturing requirements.

Figure 2:
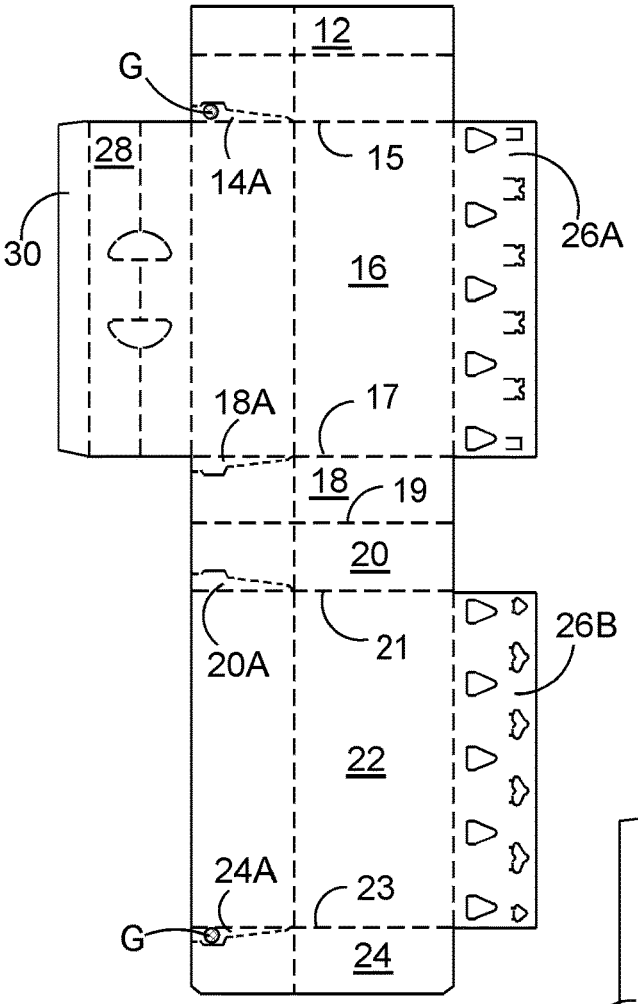
FIGS. 2 to 11 illustrate stages of construction of a carton from the blank of FIG. 1.
Figure 3:
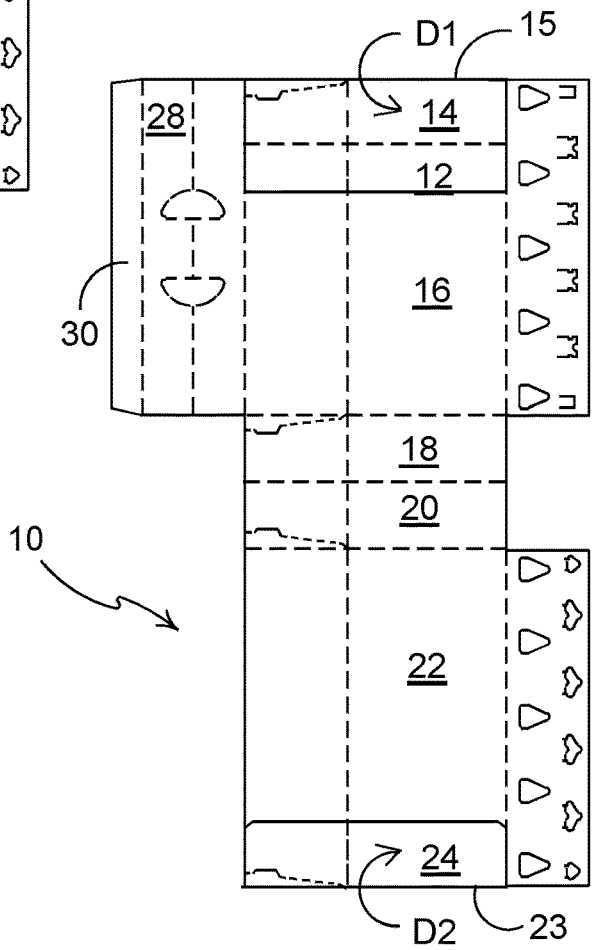

Turning to the construction of the carton 90 as illustrated in FIGS. 2 to 13, glue G or other adhesive treatment is applied to an inner surface of the first web panel 14A and to an inner surface of a fourth web panel 24A, as shown in FIG. 2. Alternatively, glue G or other adhesive treatment may be applied to corresponding portions of an inner surface of each the first and second side panels 16, 22.

The blank 10 is folded (as indicated by direction arrow D1 in FIG. 3) about the fold line 15 such that the first securing panel 12 and the first end panel 14 are disposed in overlying relationship with the first side panel 16. The first web panel 14A is secured to the upper portion 14U of the first side panel 16.

The blank 10 is folded (as indicated by direction arrow D2 in FIG. 3) about the fold line 23 such that the fourth securing panel 24 is disposed in overlying relationship with the second side panel 22. The fourth web panel 24A is secured to the upper portion 22U of the second side panel 22.

Figure 4:
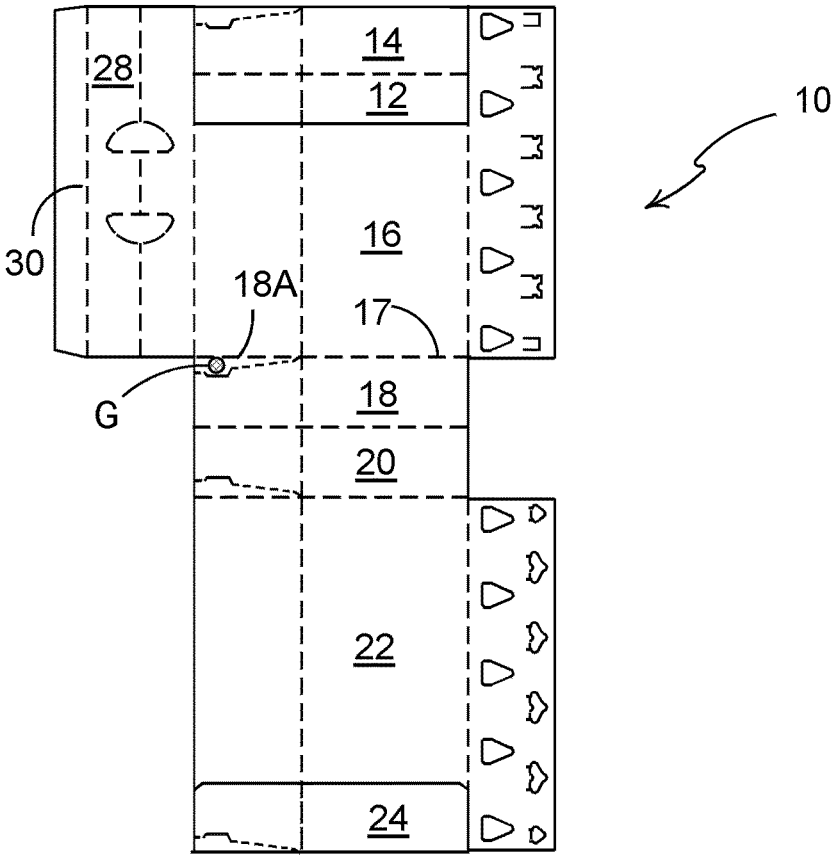
Figure 5:
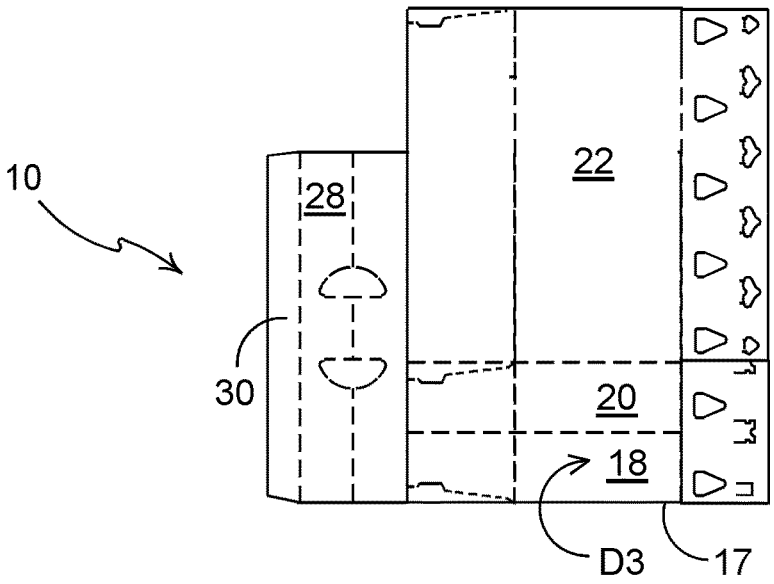
Figure 6:
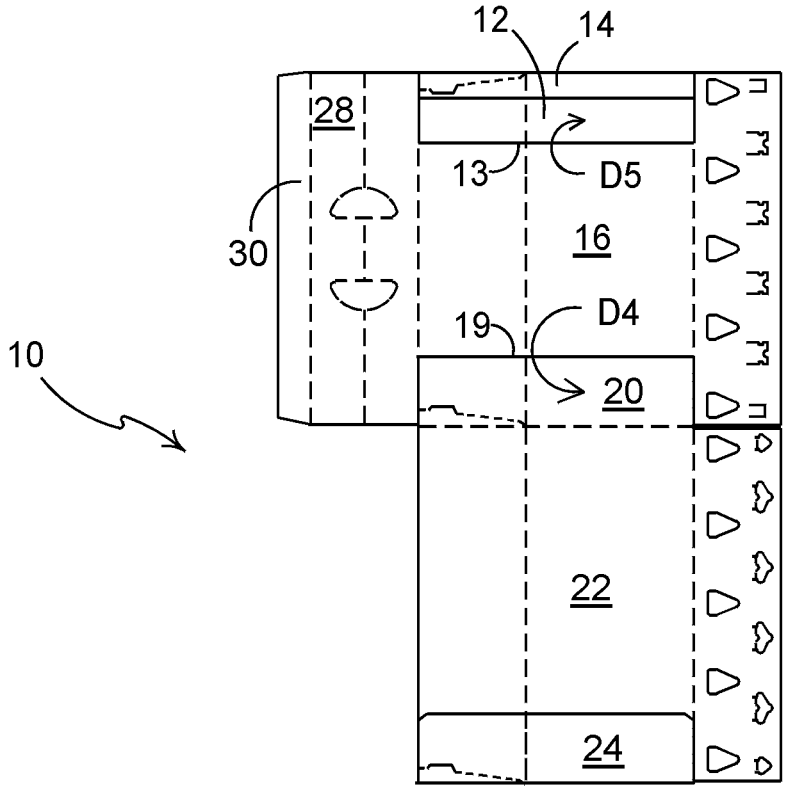

Glue G or other adhesive treatment is applied to an inner surface of a second web panel 18A, as shown in FIG. 4. Alternatively, glue G or other adhesive treatment may be applied to a corresponding portion of an inner surface of the first side panel 16.

The blank 10 is folded (as indicated by direction arrow D3 in FIG. 5) about the fold line 17 such that the second and third end panels 18, 20 are disposed in overlying relationship with the first side panel 16 and such that a portion of the second side panel 22 is disposed in overlying relationship with the first side panel 16, the first securing panel 12 and the first end panel 14.

The blank 10 is folded (as indicated by direction arrow D4 in FIG. 6) about the fold line 19 such that the third end panel 20 is disposed in overlying relationship with the second end panel 18.

The blank 10 is folded (as indicated by direction arrow D5 in FIG. 6) about the fold line 13 such that the first securing panel 12 is disposed in overlying relationship with the first end panel 14.

Figure 7:
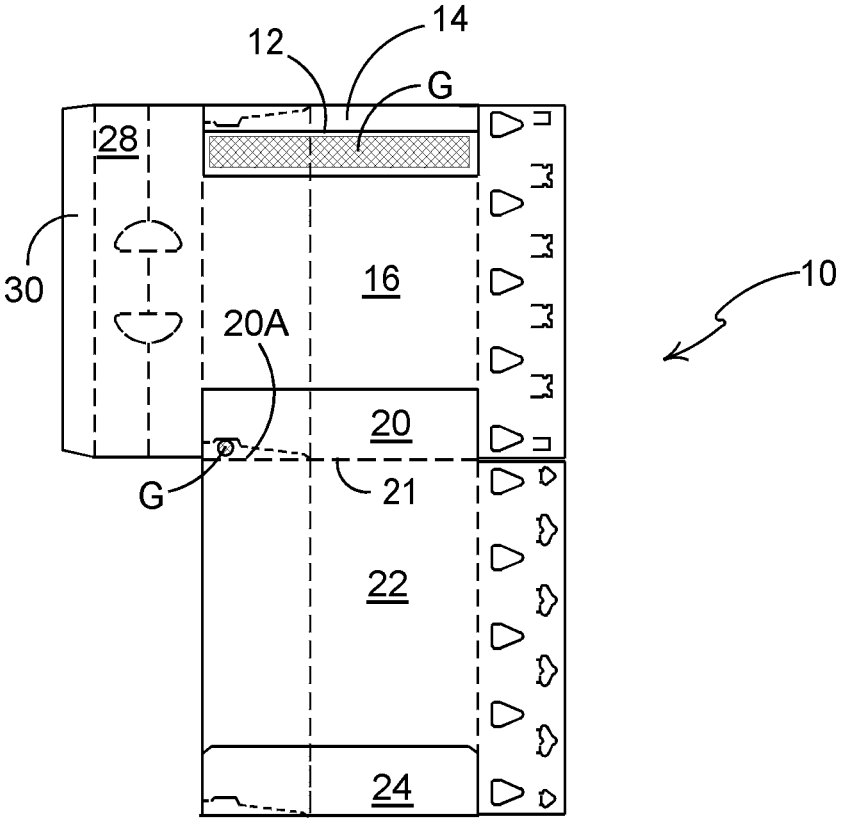
Figure 8:
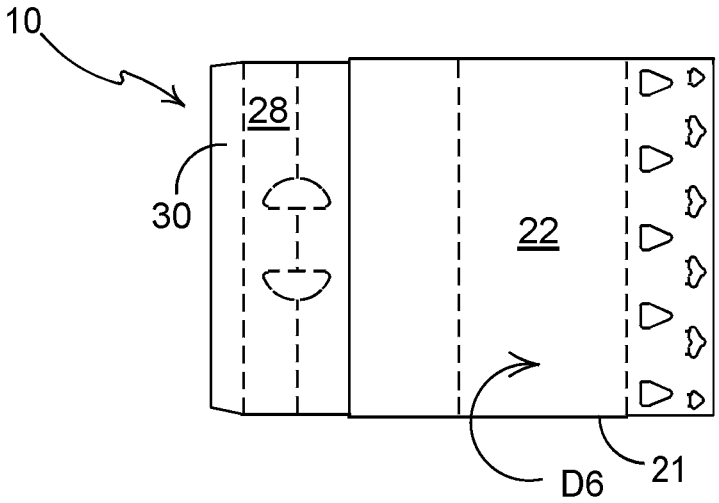

Glue G or other adhesive treatment is applied to an inner surface of the first securing panel 12, as shown in FIG. 7. Alternatively, glue G or other adhesive treatment may be applied to a corresponding portion of an outer surface of the fourth end panel 24.

Glue G or other adhesive treatment is applied to an inner surface of a third web panel 20A, as shown in FIG. 7. Alternatively, glue G or other adhesive treatment may be applied to a corresponding portion of an outer surface of the second side panel 22.

The blank 10 is folded about the fold line 21 (as indicated by direction arrow D6 in FIG. 8) such that the second side panel 18 is disposed in overlying relationship with the first side panel 16.

The third web panel 20A is secured to the second side panel 22. The fourth end panel 24 is secured to the first securing panel 12.

Figure 9:
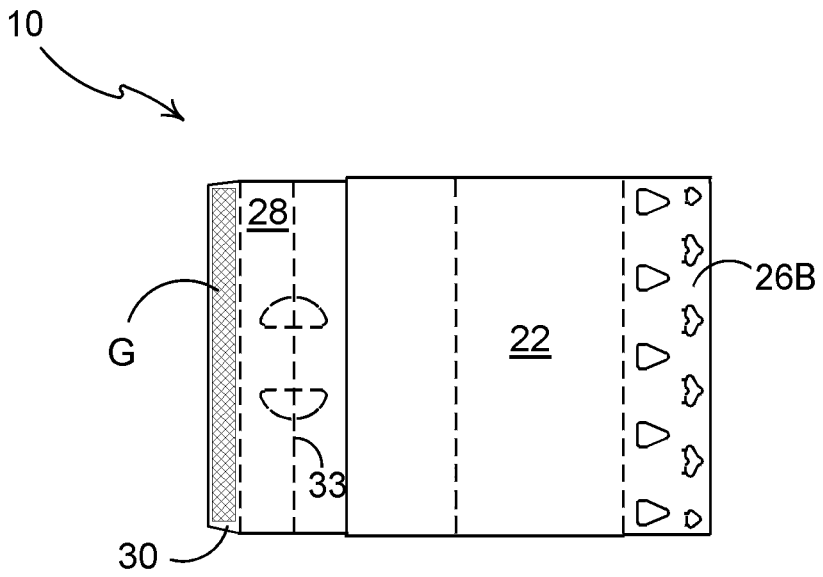
Figure 10:
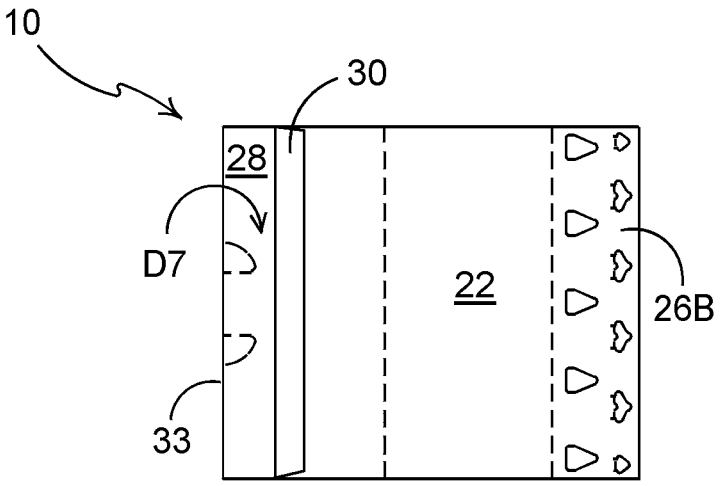
Figure 11:
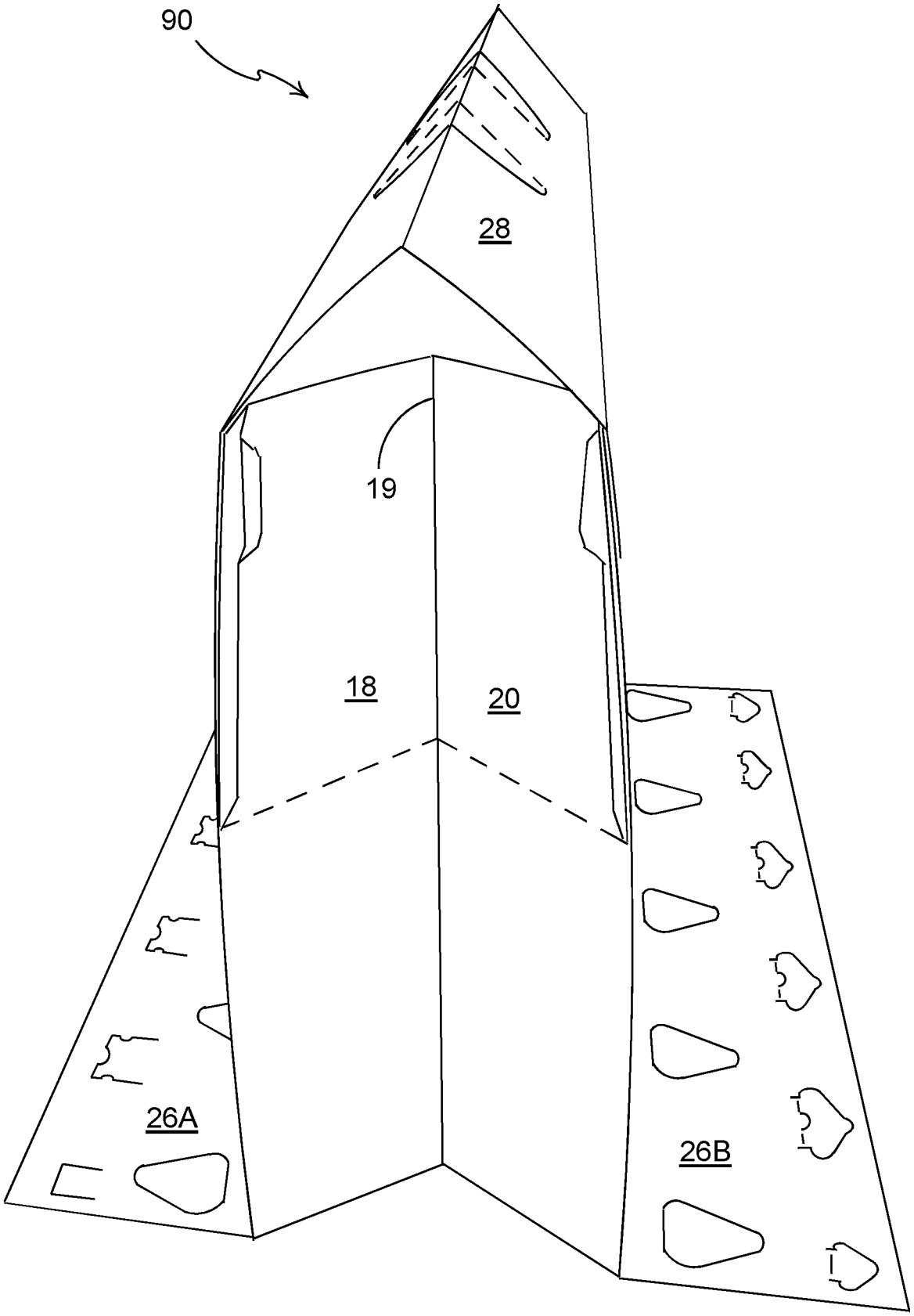

Glue G or other adhesive treatment is applied to an inner surface of the second securing panel 30, as shown in FIG. 9. Alternatively, glue G or other adhesive treatment may be applied to a corresponding edge portion of an outer surface of the second side panel 22.

The blank 10 is folded about the fold line 33 (as indicated by direction arrow D7 in FIG. 10) such that the second securing panel 30 is disposed in overlying relationship with the second side panel 22. The second securing panel 30 is secured to the second side panel 22.

The blank 10 is thus formed into a carton in a flat collapsed tubular form in which the carton can be readily shipped or distributed to a convertor plant, at which the carton in the flat collapsed tubular form may be expanded or converted into an open ended erected tubular form/structure and loaded with articles.

The carton in the flat collapsed tubular form may be erected to take the erected tubular form/structure which is open at its one end by displacement or translation of the first side panel 16 relative to the second side panel 22 such that the first side panel 14 is spaced apart from the second side panel 22. In this way the first end panel 14 is unfolded, about fold line 13, with respect to the first securing panel 12 and the fourth end panel 24 and the second end panel 18 is unfolded, about the fold line 19 with respect to the third end panel 20.

When the carton in the flat collapsed tubular form is converted into the erected tubular form, the first, second, third and fourth web structures W1, W2, W3, W4 facilitate automatic erection of the upper portions 14U, 18U, 20U, 24U of the first, second, third and fourth end panels 14, 18, 20, 24. The upper portions 14U, 18U, 20U, 24U of the first, second, third and fourth end panels 14, 18, 20, 24 are automatically folded, about the respective fold lines 35B, 35D, 35E, 35G, with respect to the respective adjacent lower portions 14L, 18L, 20L, 24L. In this way each of the opposing ends of the carton 90 are automatically erected so as to have upper portions which taper inwardly towards the top panel 28.

The carton 90 may be loaded with articles through the open end.

Once the carton 90 has been loaded with articles the open end of the carton 90 is closed.

The open end of the tubular structure is closed by folding the first base panel 26A about fold line 27A and by folding the second base panel 26B about fold line 27B into at least partial overlapping relationship with the first base panel 26A. The male components M are brought into vertical registry or alignment with the female components F.

The punch tabs in the second base panel 26B are displaced inwardly of the carton 90 so as to press the tabs provided in the first base panel 26A out of the plane of the first base panel 26A. The punch tabs are received in apertures in the first base panel 26A created by said displacement of the tabs. In this way the first and second base panels 26A, 26B are secured together.

In other embodiments alternative securing means may be employed to secure the first and second base panels 26A, 26B for example, but not limited to, mechanical locking devices such as staples, glue or other adhesive treatment.

Figure 12:
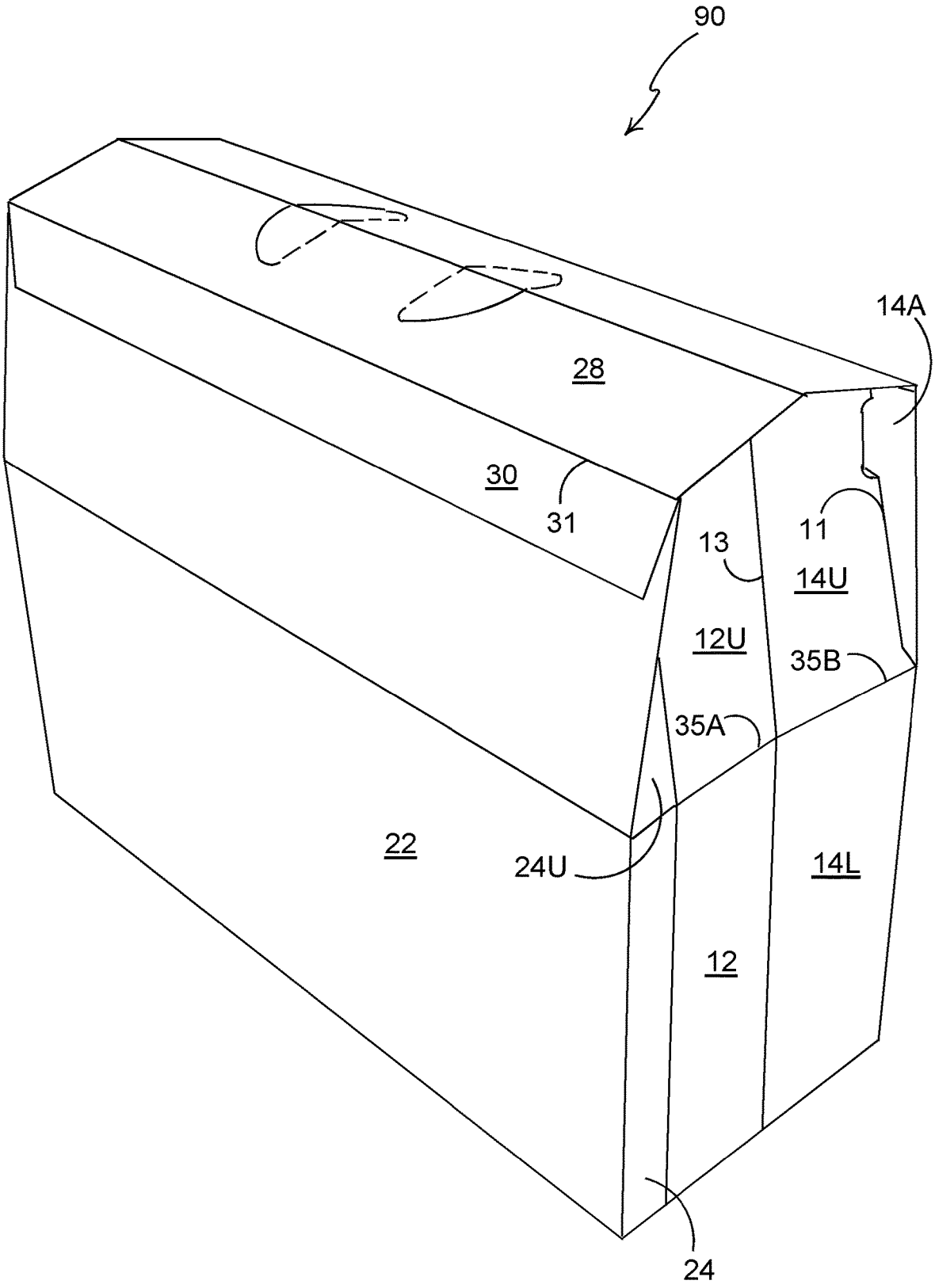
FIG. 12 is a perspective view from above and from a first side of a carton formed from the blank of FIG. 1.
Figure 13:
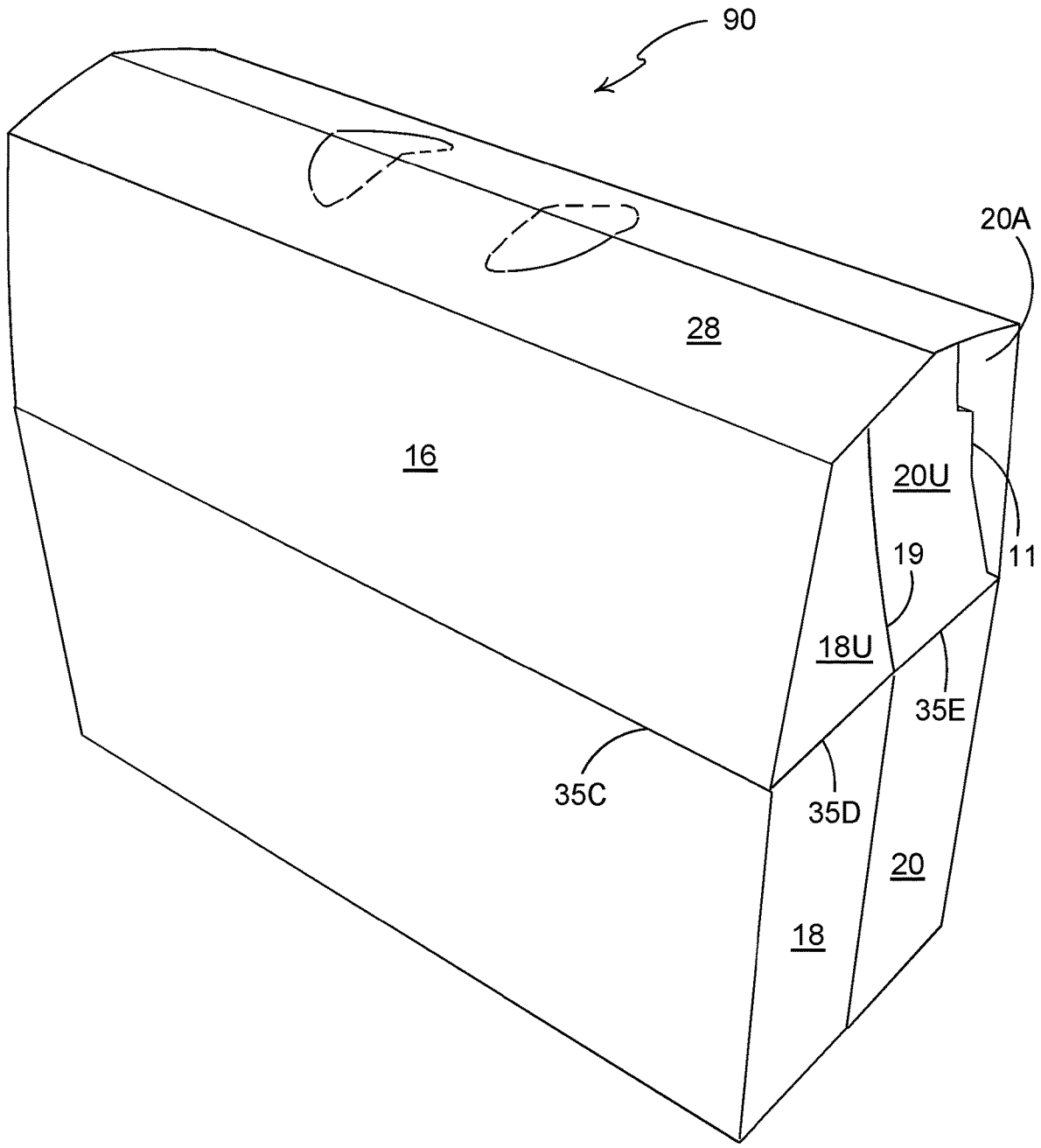
FIG. 13 is a perspective view from above and from a second side of a carton formed from the blank of FIG. 1.
Figure 14:
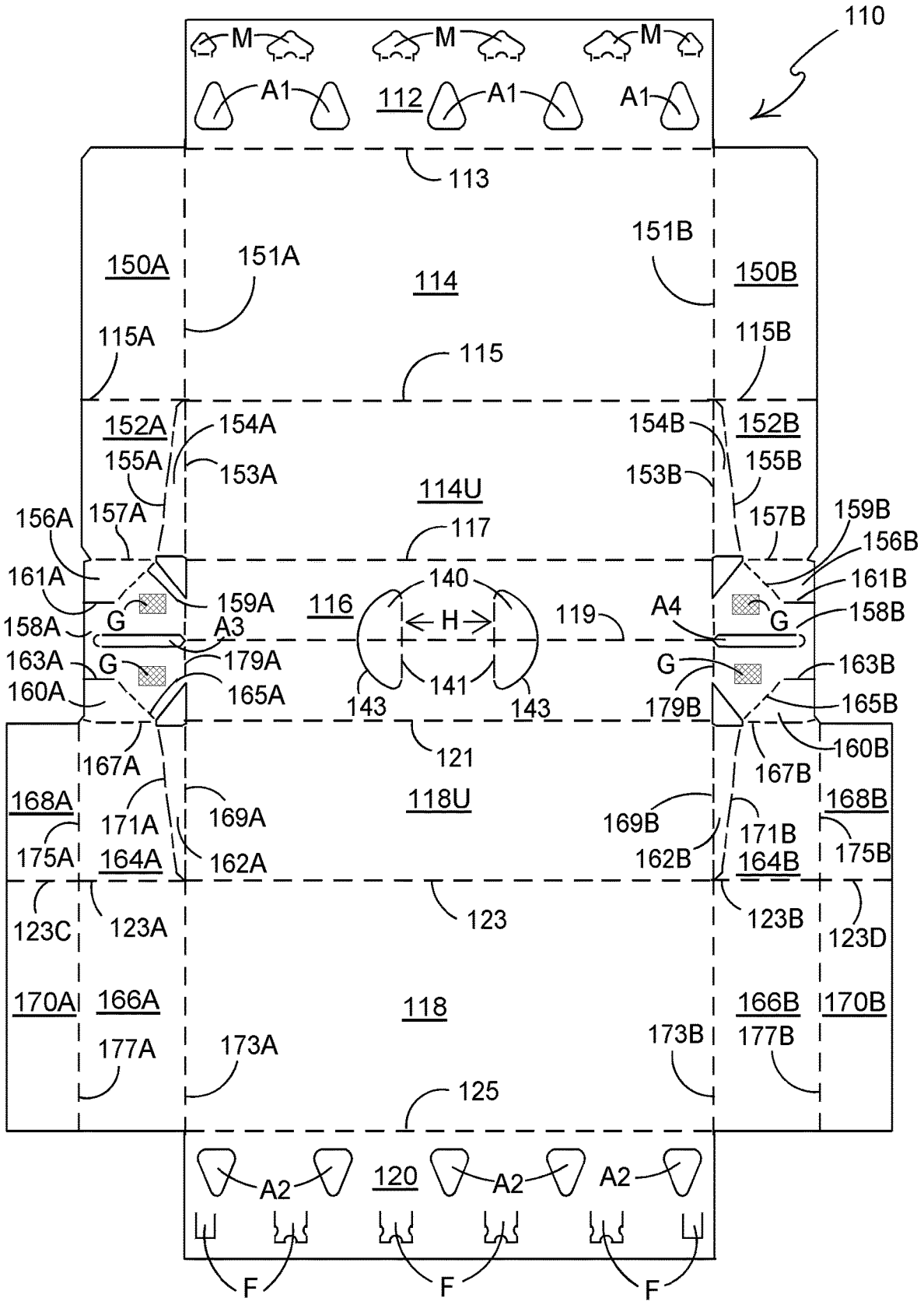
FIG. 14 is a plan view from above of a blank for forming a carton according to another embodiment of the invention.
Figure 15:
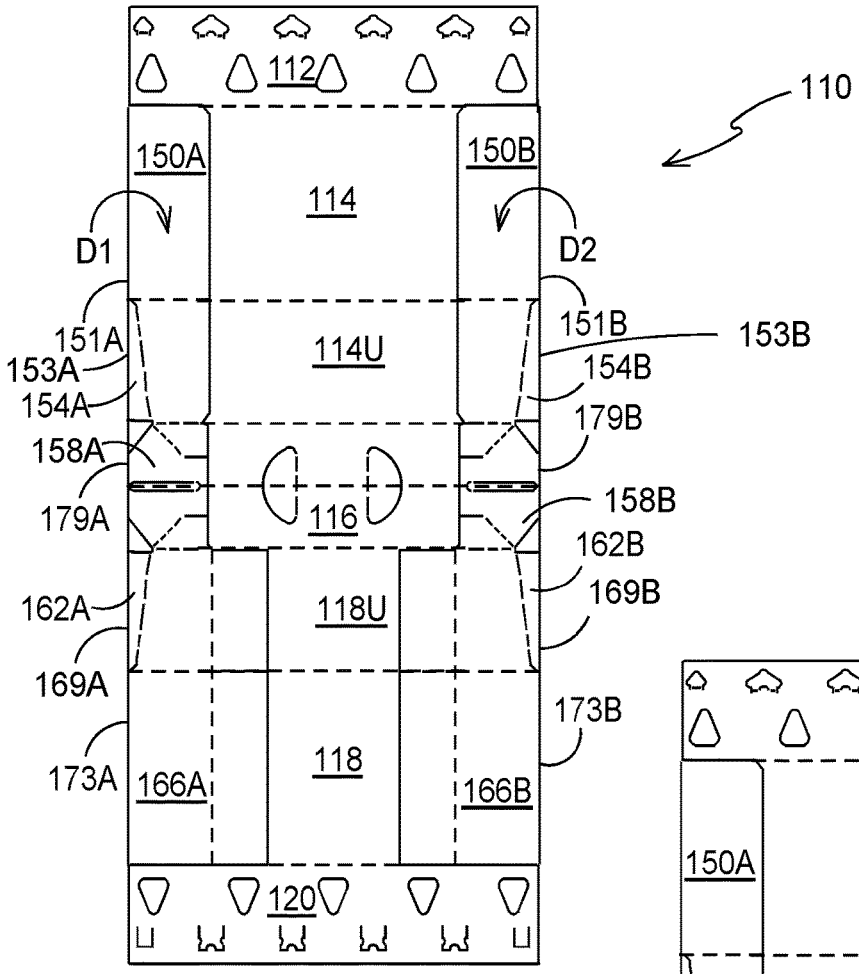
FIGS. 15 to 18 illustrate stages of construction of a carton from the blank of FIG. 14.

FIGS. 12 and 13 illustrate the assembled carton 90 forming a package with a plurality of articles (not visible).

In the erected condition, the web panels 14A, 18A, 20A, 24A are retained in an overlying or face to face relationship with the respective one of the first and second upper side panels 16U, 22U.

The web panels 14A, 18A, 20A, 24A are retained or secured in a folded condition.

When the carton is erected, the upper portions 14U, 18U, 20U, 24U of the end panels 14, 18, 20, 24 are automatically folded with respect to the lower portions 14L, 18L, 20L, 24L such that the upper portions 14U, 18U, 20U, 24U taper inwardly towards the top panel 28.

Referring now to FIGS. 14 to 19, there is shown an additional embodiment of the present disclosure.

The blank 110 comprises a plurality of main panels 112, 114, 116, 118, 120, hinged one to the next in a linear series. A first base panel 112 is hinged to a first lower side wall panel 114 by a hinged connection such as a fold line 113. The first lower side wall panel 114 is hinged to a first upper side wall panel 114U by a hinged connection such as a fold line 115. The first upper side wall panel 114U is hinged to a top panel 116 by a hinged connection such as a fold line 117. The top panel 116 is hinged to a second upper side wall panel 118U by a hinged connection such as a fold line 121. The second upper side wall panel 118U is hinged to a second lower side panel 118 by a hinged connection such as a fold line 123. The second lower side wall panel 118 is hinged to a second base panel 120 by a hinged connection such as a fold line 125.

The blank 110 comprises a complementary locking system for securing the first base panel 112 to the second base panel 120.

The second base panel 120 comprises at least one female component F in the form of an aperture defined by a tab. The tab is struck from the second base panel 120 and is hingedly connected thereto. In the illustrated embodiment the second base panel 120 comprises a plurality of female components F for example, but not limited to, six female components F.

The first base panel 112 comprises at least one male component M in the form of a punch tab. The punch tab is substantially arrowhead shaped and comprises shoulders or barbs for interlocking with the aperture of the female component F.

The first base panel 112 comprises at least one first aperture A1, for facilitating construction of the composite base panel 112/120. The second base panel 120 comprises at least one second aperture A2, for facilitating construction of the composite base panel 112/120. The first and second apertures A1, A2 are each substantially triangular in shape and may facilitate placing the first and second base panels in at least partial overlapping relationship with one another and may also facilitate alignment of the male components M in vertical registry or alignment with the female components F.

The top panel 116 comprises a handle structure H. The handle structure H comprises a pair of tabs 140 each struck from the top panel 116 and each hinged thereto by a fold line 141. Each tab 140 is defined in part by a respective severance line 143 which is substantially U-shaped or semicircular in shape. The pair of tabs 140 are hinged in opposition to each other.

The top panel 116 comprise a fold line 119 extending longitudinally thereacross. The fold line 119 substantially bisects the top panel 116.

The plurality of main panels 112, 114, 116, 118, 120 of the blank 110 form walls of a tubular structure in a set-up condition.

Each of the ends of the tubular structure is at least partially closed by end closure panels which form end walls of the tubular structure. In the illustrated embodiment the ends of the tubular structure are fully closed by end closure panels 150A, 152A, 164A, 166A, 150B, 152B, 164B, 166B.

End closure panels 150A, 152A, 164A, 166A are configured to close a first end of the tubular structure. End closure panels 150B, 152B, 164B, 166B are configured to close a second end of the tubular structure.

The first end of the tubular structure is closed by a first lower end closure panel 150A, a first upper end closure panel 152A, a second upper end closure panel 164A and a second lower end closure panel 166A. The first lower end closure panel 150A is hinged to a first end of the first lower side wall panel 114 by a hinged connection such as a fold line 151A. The first upper end closure panel 152A is hinged to a first end of the first upper side wall panel 114U by a hinged connection such as a fold line 153A. The second upper end closure panel 164A is hinged to a first end of the second upper side wall panel 118U by a hinged connection such as a fold line 169A. The second lower end closure panel 166A is hinged to a first end of the second lower side wall panel 118 by a hinged connection such as a fold line 173A.

The second end of the tubular structure is closed by a third lower end closure panel 150B, a third upper end closure panel 152B, a fourth upper end closure panel 164B and a fourth lower end closure panel 166B. The third lower end closure panel 150B is hinged to a second end of the first lower side wall panel 114 by a hinged connection such as a fold line 151B. The third upper end closure panel 152B is hinged to a second end of the first upper side wall panel 114U by a hinged connection such as a fold line 153B. The fourth upper end closure panel 164B is hinged to a second end of the second upper side wall panel 118U by a hinged connection such as a fold line 169B. The fourth lower end closure panel 166B is hinged to a second end of the second lower side wall panel 118 by a hinged connection such as a fold line 173B.

The blank 110 comprises a first upper securing panel 168A hinged to the second upper end wall panel 164A by a hinged connection such as a fold line 175A. The blank 110 comprises a first lower securing panel 170A hinged to the second lower end wall panel 166A by a hinged connection such as a fold line 177A.

The blank 110 comprises a second upper securing panel 168B hinged to the fourth upper end wall panel 164B by a hinged connection such as a fold line 175B. The blank 110 comprises a second lower securing panel 170B hinged to the fourth lower end wall panel 166B by a hinged connection such as a fold line 177B.

The first lower end wall panel 150A is hinged to the first upper end wall panel 152A by a hinged connection such as a fold line 115A. The second lower end wall panel 166A is hinged to the second upper end wall panel 164A by a hinged connection such as a fold line 123A. The third lower end wall panel 150B is hinged to the third upper end wall panel 152B by a hinged connection such as a fold line 115B. The fourth lower end wall panel 166B is hinged to the fourth upper end wall panel 164B by a hinged connection such as a fold line 123B.

The first upper securing panel 168A is hinged to the first lower securing panel 170A by a hinged connection such as a fold line 123C. The second upper securing panel 168B is hinged to the second lower securing panel 170B by a hinged connection such as a fold line 123D.

The blank 110 comprises a first anchor panel 158A hinged to a first end of top panel 116 by a hinged connection such as fold line 179A. The first anchor panel 158A may optionally comprise a first elongate aperture A3 extending partially thereacross. The first aperture A3 comprises a longitudinal axis which is substantially aligned with the fold line 119.

The blank 110 comprises a first gusset panel 156A. The first gusset panel 156A is hingedly connected to an upper edge of the first upper end closure panel 152A, by a fold line 157A. The first gusset panel 156A is hingedly connected to the first anchor panel 158A, by a fold line 159A. The first gusset panel 156A is defined in part by a cut line or severance line 161A extending between a free end edge of the first gusset panel 156A and the fold line 159A. The cut line or severance line 161A partially separates, or at least enables partial separation of the first gusset panel 156A from the first anchor panel 158A.

The blank 110 comprises a second gusset panel 160A. The first gusset panel 160A is hingedly connected to an upper edge of the second upper end closure panel 164A, by a fold line 167A. The second gusset panel 160A is hingedly connected to the first anchor panel 158A, by a fold line 165A. The second gusset panel 160A is defined in part by a cut line or severance line 163A extending between a free end edge of the second gusset panel 160A and the fold line 165A. The cut line or severance line 163A partially separates, or at least enables partial separation of the second gusset panel 160A from the first anchor panel 158A.

The blank 110 comprises a second anchor panel 158B hinged to a second end of top panel 116 by a hinged connection such as fold line 179B. The second anchor panel 158B may optionally comprise a second elongate aperture A4 extending partially thereacross. The second aperture A4 comprises a longitudinal axis which is substantially aligned with the fold line 119.

The blank 110 comprises a third gusset panel 156B. The third gusset panel 156B is hingedly connected to an upper edge of the third upper end closure panel 152B, by a fold line 157B. The third gusset panel 156B is hingedly connected to the second anchor panel 158B, by a fold line 159B. The third gusset panel 156B is defined in part by a cut line or severance line 161B extending between a free end edge of the third gusset panel 156B and the fold line 159B. The cut line or severance line 161B partially separates, or at least enables partial separation of the third gusset panel 156B from the second anchor panel 158B.

The blank 110 comprises a fourth gusset panel 160B. The fourth gusset panel 160B is hingedly connected to an upper edge of the fourth upper end closure panel 164B, by a fold line 167B. The fourth gusset panel 160B is hingedly connected to the second anchor panel 158B, by a fold line 165B. The fourth gusset panel 160B is defined in part by a cut line or severance line 163B extending between a free end edge of the fourth gusset panel 160B and the fold line 165B. The cut line or severance line 163B partially separates, or at least enables partial separation of the fourth gusset panel 160B from the second anchor panel 158B.

The blank 110 comprises a first web panel 154A formed from or defined in the first upper end closure panel 152A. The first web panel 154A is defined in part by fold line 153A between the first upper end closure panel 152A and the first upper side wall panel 114U.

The first web panel 154A is defined in part by a fold line 155A extending from a vertex between fold line 153A and fold line 115A. The fold line 155A is divergently arranged with respect to the fold line 153A. The fold lines 153A, 155A diverge towards an upper edge of the first upper end closure panel 152A.

The blank 110 comprises a second web panel 162A formed from or defined in the second upper end closure panel 164A. The second web panel 162A is defined in part by fold line 169A between the second upper end closure panel 164A and the second upper side wall panel 118U. The second web panel 162A is defined in part by a fold line 171A extending from a vertex between fold line 169A and fold line 123A. The fold line 171A is divergently arranged with respect to the fold line 169A. The fold lines 169A, 171A diverge towards an upper edge of the second upper end closure panel 164A.

The blank 110 comprises a third web panel 154B formed from or defined in the third upper end closure panel 152B. The third web panel 154B is defined in part by fold line 153B between the third upper end closure panel 152B and the first upper side wall panel 114U. The third web panel 154B is defined in part by a fold line 155B extending from a vertex between fold line 153B and fold line 115B. The fold line 155B is divergently arranged with respect to the fold line 153B. The fold lines 153B, 155B diverge towards an upper edge of the third upper end closure panel 152B.

The blank 110 comprises a fourth web panel 162B formed from or defined in the fourth upper end closure panel 164B. The fourth web panel 162B is defined in part by fold line 169B between the fourth upper end closure panel 164B and the second upper side wall panel 118U. The fourth web panel 162B is defined in part by a fold line 171B extending from a vertex between fold line 169B and fold line 123B. The fold line 171B is divergently arranged with respect to the fold line 169B. The fold lines 169B, 171B diverge towards an upper edge of the fourth upper end closure panel 164B.

Turning to the construction of the carton 190 as illustrated in FIGS. 15 to 19, optionally glue G or other adhesive treatment (see FIG. 14) may be applied to an inner surface of the first anchor panel 158A and to an inner surface of the second anchor panel 158B. Alternatively, glue G or other adhesive treatment may be applied to corresponding portions of an inner surface of top panel 116.

The blank 110 is folded (as indicated by direction arrow D1 in FIG. 15) about the fold lines 151A, 153A, 179A, 169A, 173A such that; the first lower end panel 150A is disposed in overlying relationship with the first lower side panel 114, the first upper end panel 152A is disposed in overlying relationship with the first upper side panel 114U, the first anchor panel 158A is disposed in overlying relationship with the top panel 116, the second upper end panel 164A is disposed in overlying relationship with the second upper side panel 118U and the second lower end panel 166A is disposed in overlying relationship with the second lower side panel 118.

The first anchor panel 158A may be secured to the top panel 116.

The blank 110 is folded (as indicated by direction arrow D2 in FIG. 15) about the fold lines 151B, 153B, 179B, 169B, 173B such that; the third lower end panel 150B is disposed in overlying relationship with the first lower side panel 114, the third upper end panel 152B is disposed in overlying relationship with the first upper side panel 114U, the second anchor panel 158B is disposed in overlying relationship with the top panel 116, the fourth upper end panel 164B is disposed in overlying relationship with the second upper side panel 118U and the fourth lower end panel 166B is disposed in overlying relationship with the second lower side panel 118.

The second anchor panel 158B may be secured to the top panel 116.

The blank 110 is folded (as indicated by direction arrow D3 in FIG. 16) about the fold lines 175A, 177A such that the first upper securing panel 168A is disposed in overlying relationship with the second upper end panel 164A. The first lower securing panel 170A is disposed in overlying relationship with the second lower end panel 166A.

The blank 110 is folded (as indicated by direction arrow D4 in FIG. 16) about the fold lines 175B, 177B such that the second upper securing panel 168B is disposed in overlying relationship with the fourth upper end panel 164B. The second lower securing panel 170B is disposed in overlying relationship with the fourth lower end panel 166B.

Figure 16:
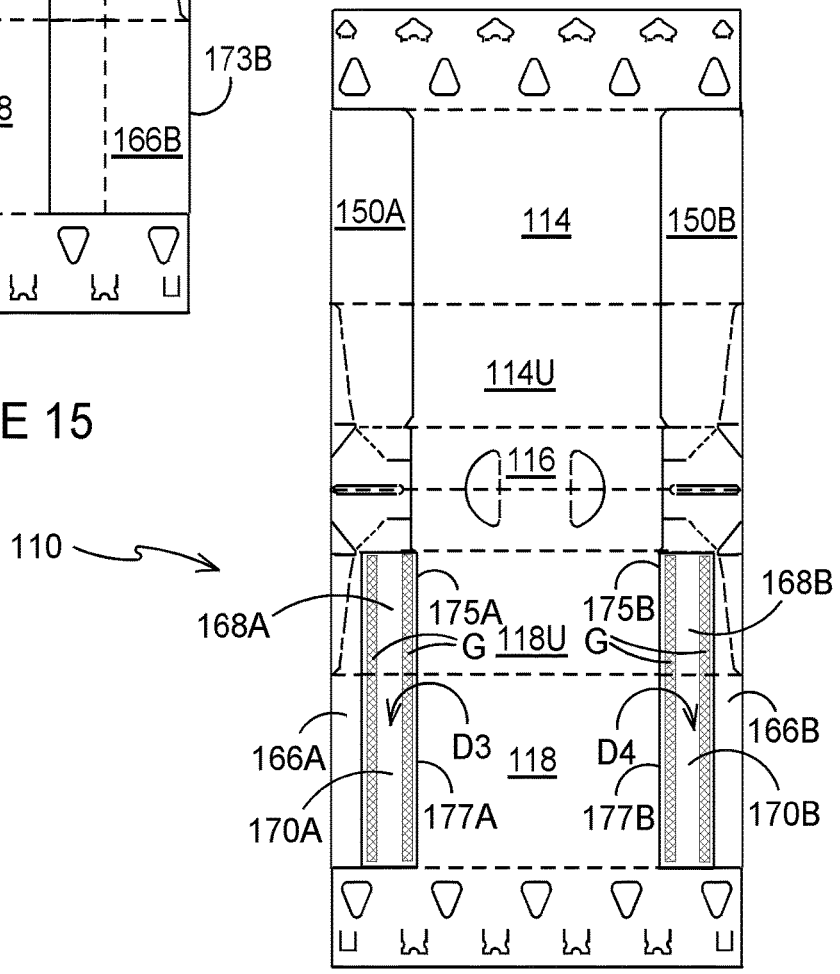
Figure 17:
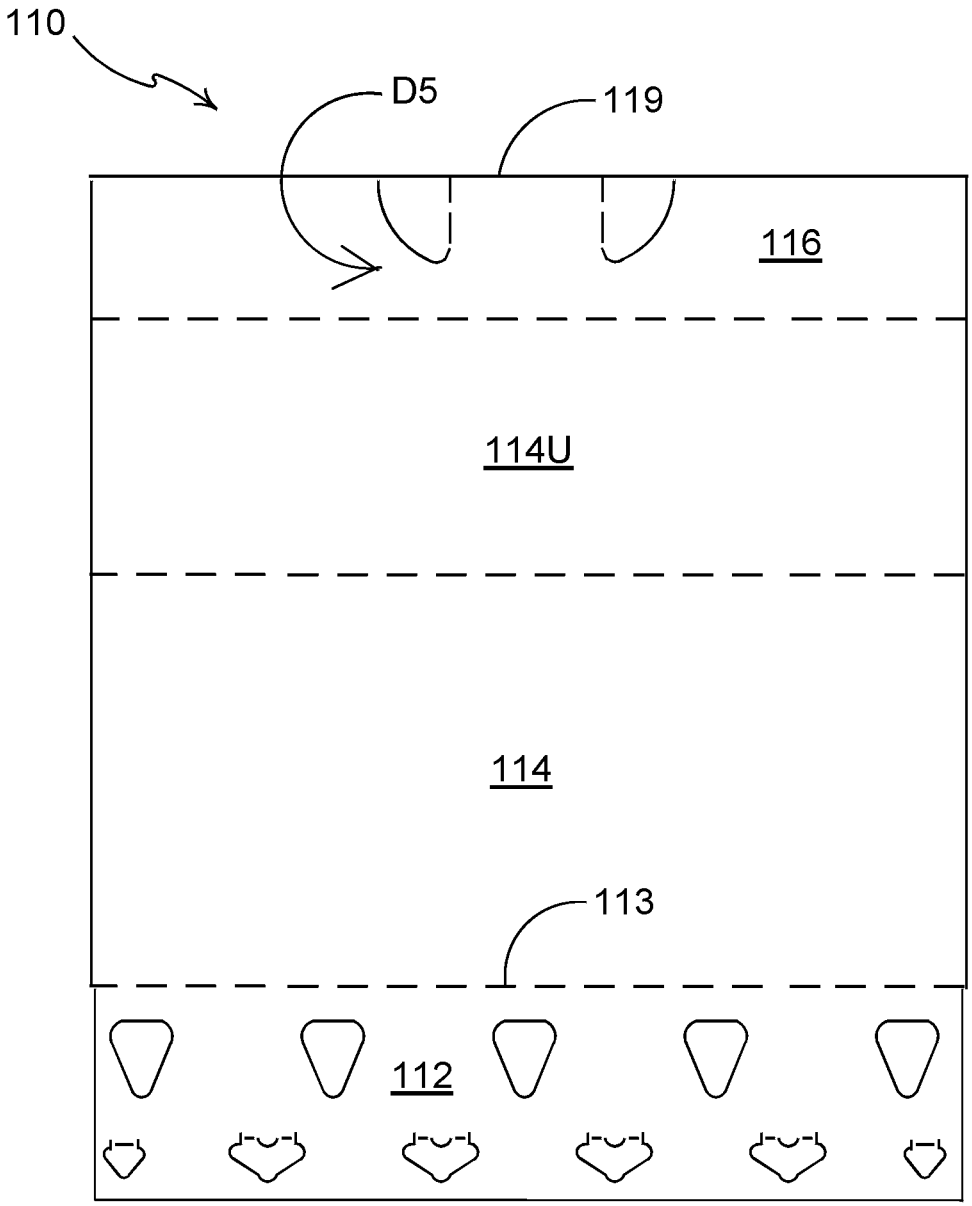
Figure 18:
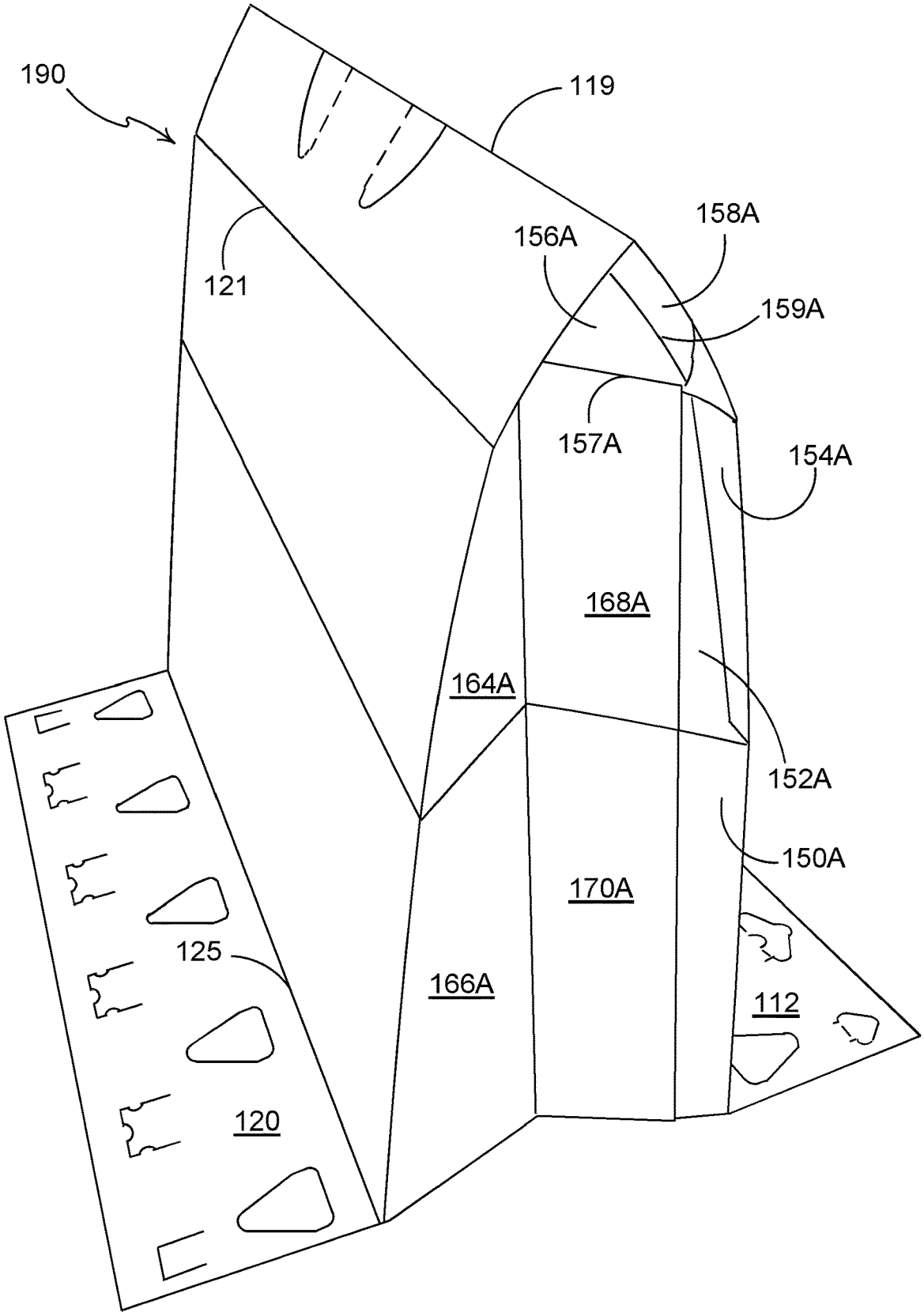

Glue G or other adhesive treatment is applied to an inner surface of each of the first and second upper securing panels 168A, 168B and the first and second lower securing panels 170A, 170B, as shown in FIG. 16. Alternatively, glue G or other adhesive treatment may be applied to corresponding portions of an outer surface of the first upper end panel 152A, third upper end panel 152B, first lower end panel 150A and third lower end panel 150B.

The blank 110 is folded (as indicated by direction arrow D5 in FIG. 17) about the fold line 119 such that the first upper side panel 114U is disposed in overlying relationship with the second upper side panel 118U. The first lower side panel 114 is disposed in overlying relationship with the second lower side panel 118.

The first upper securing panel 168A is secured to the first upper end panel 152A. The first lower securing panel 170A is secured to the first lower end panel 150A. The second upper securing panel 168B is secured to the third upper end panel 152B. The second lower securing panel 170B is secured to the third lower end panel 150B.

The blank 110 is thus formed into a carton in a flat collapsed tubular form which can be readily shipped or distributed to a convertor plant, at which the carton in the flat collapsed tubular form may be expanded or converted into an open ended tubular form or structure and loaded with articles.

The carton in the flat collapsed tubular form may be erected into the tubular form which is open at its one end by displacement or translation of the first upper and lower side panels 114U, 114 relative to the second upper and lower side panels 118U, 118 such that the first upper and lower side panels 114U, 114 are spaced apart from the respective one of the second upper and lower side panels 118U, 118.

When the carton in the flat collapsed tubular form is erected into the erected tubular form, the first and second anchor panels 158A, 158B facilitate automatic erection of the carton 190 into a gable top style carton. In this way each of the opposing ends of the carton 190 are automatically erected so as to have upper portions which taper inwardly towards the top panel 116.

The carton 190 may be loaded with articles through the open end.

Once the carton 190 has been loaded with articles the open end of the carton 190 is closed.

The open end of the tubular form is closed by folding the second base panel 120 about fold line 125 and by folding the first base panel 112 about fold line 113 into at least partial overlapping relationship with the second base panel 120. The male components M are brought into vertical registry or alignment with the female components F.

The punch tabs in the first base panel 112 are displaced inwardly of the carton 190 so as to press the tabs provided in the second base panel 120 out of the plane of the second base panel 120. The punch tabs are received in apertures in the second base panel 120 created by said displacement of the tabs. In this way the first and second base panels 112, 120 are secured together.

In other embodiments alternative securing means may be employed to secure the first and second base panels 112, 120 for example, but not limited to, mechanical locking devices such as staples, glue or other adhesive treatment.

Figure 19:
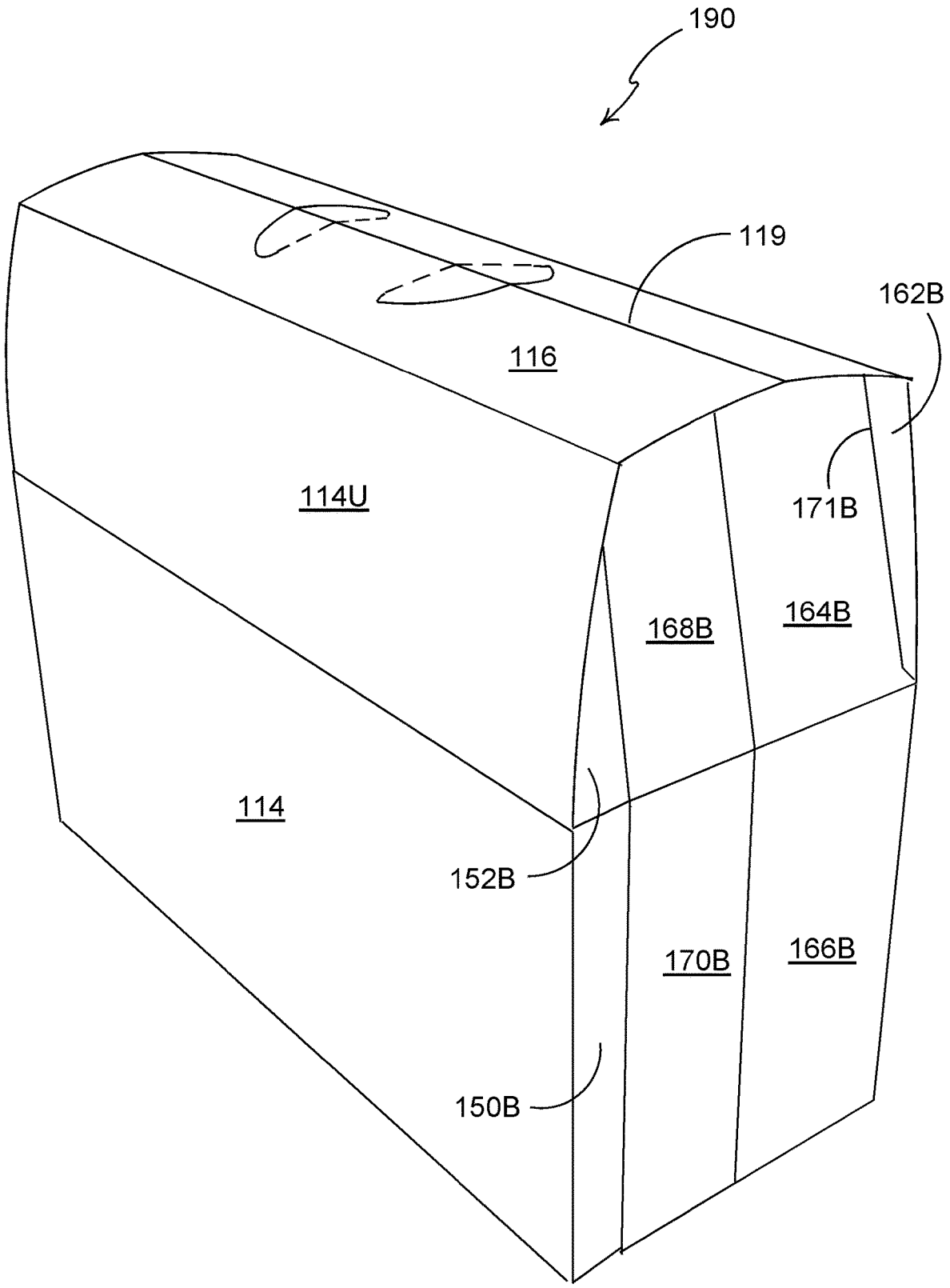
FIG. 19 is a perspective view from above of a carton formed from the blank of FIG. 14.

FIG. 19 illustrates the assembled carton 190 forming a package with a plurality of articles (not visible).

In the erected condition, the web panels 154A, 154B, 162A, 162B are retained in face to face relationship with the first or second upper side panels 114U, 118U respectively.

The web panels 154A, 154B, 162A, 162B are retained in a folded condition.

When the carton is erected the upper end panels 152A, 152B, 164A, 164B are automatically folded with respect to the lower end panels 150A, 150B, 166A, 166B such that the upper end panels 152A, 152B, 164A, 164B taper inwardly towards the top panel 116.

In some embodiments the web panels 154A, 154B, 162A, 162B may be omitted, the coupling between the anchor panels 158A, 158B and the respective upper end panels 152A, 152B, 164A, 164B facilitates automatic erection of the carton 190 such that the upper end panels 152A, 152B, 164A, 164B are tapered inwardly towards the top panel 116. In such embodiments the upper end panels 152A, 152B, 164A, 164B may be severable from the respective one of the first and second upper side panels, for example the fold lines 153A, 153B, 169A, 169B, may be replaced with severance or cut lines. Alternatively, an aperture may be defined in the upper end panels 152A, 152B, 164A, 164B, for example the web panels 154A, 154B, 162A, 162B may be replaced by apertures or cutaways.

It can be appreciated that various changes may be made within the scope of the present invention. For example, the size and shape of the panels and apertures may be adjusted to accommodate articles of differing size or shape.

Whilst the foregoing embodiments have been described with reference to a fully enclosed carton it is envisaged that the dispenser may be employed in cartons of alternative design such as, but not limited to, wraparound style cartons, basket carriers and top gripping clips.

It will be recognized that as used herein, directional references such as "top", "base", "front", "back", "end", "side", "inner", "outer", "upper" and "lower" do not limit the respective panels to such orientation, but merely serve to distinguish these panels from one another. Any reference to "hinged connection" should not be construed as necessarily referring to a single fold line only; indeed it is envisaged that a hinged connection can be formed from one or more of the following: a short slit, a frangible line or a fold line, without departing from the scope of the invention. It can be appreciated that various changes may be made within the scope of the present invention. For example, the size and shape of the panels and apertures may be adjusted to accommodate articles of differing size or shape.

As used herein, the terms "hinged connection" and "fold line" each refers to all manner of lines that define hinge features of the blank or substrate of sheet material, facilitate folding portions of the blank or substrate of sheet material with respect to one another, or otherwise indicate optimal panel folding locations for the blank or substrate of sheet material. Any reference to "hinged connection" should not be construed as necessarily referring to a single fold line only; indeed a hinged connection can be formed from one or more fold lines.

As used herein, the term "fold line" may refer to one of the following: a scored line, an embossed line, a debossed line, a line of perforations, a line of short slits, a line of half-cuts, a single half-cut, an interrupted cut line, aligned slits, a line of short scores and any combination of the aforesaid options, without departing from the scope of the invention.

As used herein, the term "severance line" may refer to all manner of lines formed in the blank or substrate of sheet material that facilitate separating portions of the blank or substrate of sheet material from one another, or otherwise that indicate optimal separation locations on the blank or substrate. As used herein, the term "severance line" may refer to one of the following: a single cut line, a single partial-depth cut line (e.g., a single half-cut line), an interrupted cut line, a score line, an interrupted score line, a line of perforations, a line of short cuts, a line of short slits, a line of short partial-depth cuts (e.g., a line of short half cuts), and any combination of the aforementioned options.

It should be understood that hinged connections, fold lines and severance lines can each include elements that are formed in the blank or substrate of sheet material, including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking to provide a fold line, to facilitate folding and facilitate breaking with more effort to provide a frangible fold line, or to facilitate breaking with little effort to provide a severance line.

The invention claimed is:

1. A carton for packaging one or more articles, the carton comprising a plurality of panels for forming walls of the carton including:

a first side panel;

a first end panel having an upper portion and a lower portion;

a web panel formed from part of the upper portion and hinged to the first side panel along a first fold line, the web panel being hinged to a remaining part of the upper portion along a second fold line, the second fold line being divergently arranged with respect to the first fold line such that the first and second fold lines diverge with respect to each other towards an upper edge of the first end panel, wherein the carton is convertible from a flat collapsed form into an erected form, wherein in the flat collapsed form, the first side panel is disposed in an overlying or face to face relationship with the first end panel, wherein in the erected form, the first side panel and the first end panel form adjacent walls of a tubular structure and define at least in part an interior of the carton for receiving one or more articles, wherein the web panel is secured in face to face relationship with the first side panel when the carton is in the flat collapsed form, wherein the upper portion and the lower portion are hinged to one another along a third fold line, wherein the second fold line originates at a point generally adjacent to a vertex between the first fold line and the third fold line, wherein a first cut line is defined in the upper portion and extends from the vertex towards a first end of the second fold line, wherein a second cut line interrupts the second fold line, and wherein the second cut line is substantially U-shaped.

2. A carton according to claim 1, wherein the web panel is adhesively secured to the first side panel when the carton is in the flat collapsed form.

3. The carton according to claim 1, further comprising a top panel and wherein the carton is of gable top style.

4. The carton according to claim 1, wherein the web panel is formed such that the upper portion of the first end panel tapers inwardly towards the top panel in the erected form.

* * * * *